United States Patent [19]

Wier

[11] Patent Number: 4,597,141

[45] Date of Patent: Jul. 1, 1986

[54] BELT LOCK FOR A SAFETY BELT

[75] Inventor: Franz Wier, Goggingen, Fed. Rep. of Germany

[73] Assignee: TRW Repa GmbH, Alfdorf, Fed. Rep. of Germany

[21] Appl. No.: 653,956

[22] Filed: Sep. 21, 1984

[30] Foreign Application Priority Data

Oct. 14, 1983 [DE] Fed. Rep. of Germany ..... 3337473

[51] Int. Cl.[4] ..... A44B 11/26

[52] U.S. Cl. ..... 24/633; 24/639; 24/642

[58] Field of Search ..... 24/633, 634, 635, 639, 24/640, 641, 642, 643, 644, 645, 646, 647, 651

[56] References Cited

U.S. PATENT DOCUMENTS

| | | | |
|---|---|---|---|
| 4,000,548 | 1/1977 | Stephenson et al. | 24/639 |
| 4,094,046 | 6/1978 | Takada | 24/642 |
| 4,136,425 | 1/1979 | Esner | 24/641 |
| 4,197,619 | 4/1980 | Burleigh | 24/642 |
| 4,266,325 | 5/1981 | Ennerdal et al. | 24/640 |
| 4,358,879 | 11/1982 | Nagyar | 24/641 |
| 4,384,391 | 5/1983 | Lindblad et al. | 24/633 |
| 4,391,023 | 7/1983 | Tanaka et al. | 24/633 |

*Primary Examiner*—Victor N. Sakran
*Attorney, Agent, or Firm*—Yount & Tarolli

[57] ABSTRACT

A safety belt lock has a lock housing with an insertion path for an insertion tongue of a safety belt. The insertion opening of the insertion path is defined between opposed resilient flange members bearing on surface portions of the insertion tongue to generate mutually perpendicular clamping forces whereby any rattling noises are avoided.

14 Claims, 4 Drawing Figures

BELT LOCK FOR A SAFETY BELT

The invention relates to a belt lock for a safety belt.

In known belt locks of this kind, the insertion path for the insertion tongue fastened to the free end of a flexible belt band, is limited by an insertion opening, is formed by the lock sheath or lock shell, of plastic, for example. For the locking of the insertion tongue, this latter is inserted, against the spring force of an ejector, for example, into the insertion path until the insertion tongue is locked behind the metal bar, movable transverse to the insertion path. In the zone of the insertion opening, play is present between the insertion tongue and the opening flange surrounding the insertion opening, so that as a result of the shaking movement of the vehicle, the insertion tongue, with turning point on the bar, can easily swing back and forth in practically any direction, by which a disturbing knocking noise is given.

The invention attacks the problem of designing a belt lock, so that with simple constructive design and without additional parts, knocking noises can be completely prevented.

With the solution according to the invention, the insertion tongue, in addition to the locking point at the bar, is also stopped, at a relatively great distance from the said point, in the zone of the insertion opening, with clamping, so that the insertion tongue can no longer describe any swinging movement, and therefore, knocking noises no longer occur. This clamping takes place through a springing element, the insertion tongue being pressed by a formed addition, but preferably by a partly surrounding jacketing, in such manner against inclined surfaces of the opening flange of the insertion opening, that on the insertion tongue acts a pressure force against the insertion direction and at least one other pressure force, at an angle, of 90°, for example, in relation to the insertion direction, by which a free shaking movement of the insertion tongue around the turning point on the bar is prevented with certainty. Preferably, here, a part of the opening flange is designed as a springy element, for example, through a rounded or beveled edge of the pressure key, movable against spring force, or through a springy part or addition of the lock shell itself.

The force ratio of the above-mentioned pressure forces is chosen so that the insertion tongue, excited to vibrations by the vehicle, cannot move the springy element, for example, the pressure key in the insertion direction, so that, for example, a spontaneous release of the pressure key never take place.

Advantageous embodiments of the invention are given from the example of execution represented in the drawings and described hereinafter.

Figure 1:
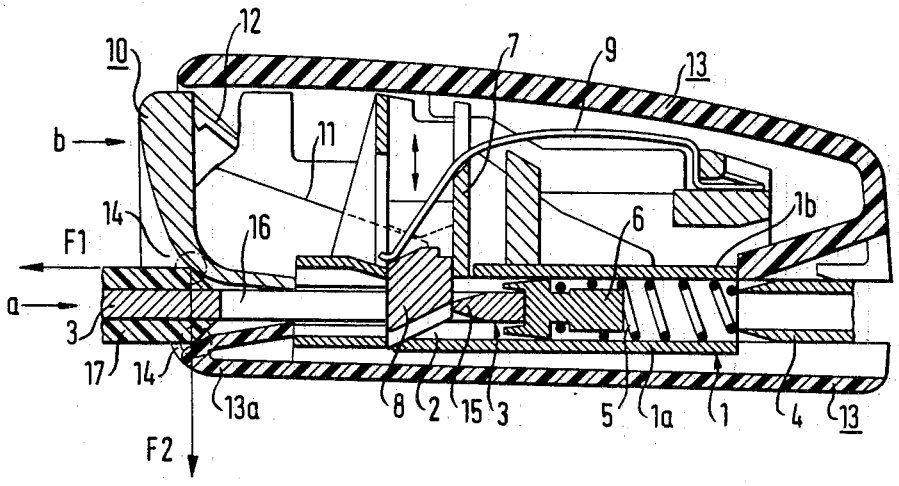
FIG. 1 shows the section view of the belt lock according to the invention with the insertion tongue inserted and clamped.
Figure 2:
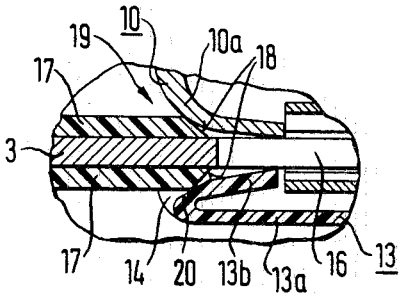
FIG. 2 shows an enlarged detail of the belt lock according to the invention.
Figure 3:
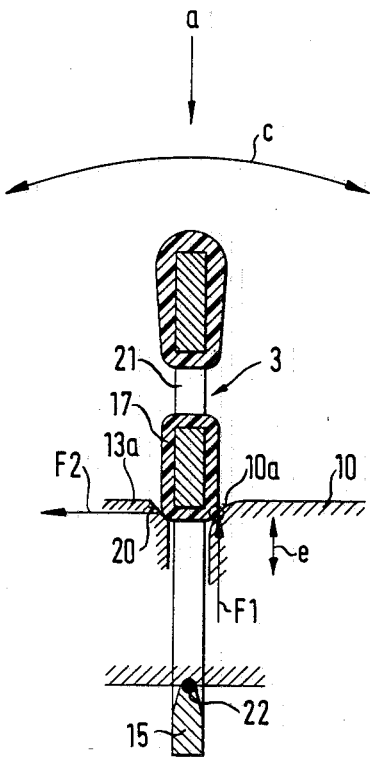
FIGS. 3 and 4 show diagrams of the insertion tongue and belt lock in side view and in top view to make clear the clamping forces.
Figure 4:
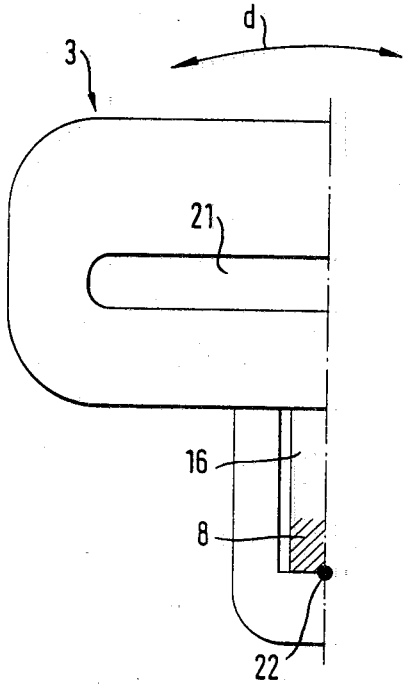

FIGS. 1 and 2 show the construction of the belt lock. Here, the stable base for the belt lock is a metal lock housing 1, bent in a U-shape, for example, with, essentially, two plates 1*a* and 1*b*, running parallel to each other, which limit an insertion path 2 for a belt band insertion tongue 3. By a rear addition 4, the lock housing 1 is connected with a fitting, not shown, which is fastened, for example, to the floor of the motor vehicle. In an extension of the insertion path 2, between the two plates 1*a* and 1*b*, is guided movable against the force of a spring 5, an ejector 6, which by insertion of the tongue 3, in the arrow direction a, is pushed back resiliently. In a guide 7, arranged perpendicular to the insertion path 2, is guided movable in the arrow direction, a bar 8, which is beveled at the free end. This bar 8 is pressed by a spring 9 into the locking position according to FIG. 1, in which the bar 8 engages in the insertion path 2. For the adjustment of the bar 8 into the release position outside the insertion path 2 is used a pressure key 10, which has a curve addition 11, which cooperates with the bar 8 so that, with the pushing of the pressure key 10 in the arrow direction b against the forces of a spring 12, it is raised out of the position according to FIG. 1 into the released position outside the insertion path 2. The lock housing 1 as well as the parts mentioned above are surrounded by a lock sheath or, for example, a two-part lock shell 13, made of plastic. Here, the lock shells 13, that is, the lower shell part 13*a* in FIG. 1 and the lower limit of the pressure key 10, together with two side flange parts of the shell part 13*a*, form an insertion opening 14 for the tongue 3, which insertion opening is aligned with the insertion path 2. For the locking of the insertion tongue 3, this is inserted through the insertion opening 14 into the insertion path 2, and is locked by a catch edge 15 on the bar 8, as FIG. 1 shows. For the formation of the catch edge, the insertion tongue 3 has at the insertion end an opening 16. The insertion tongue 3 has a jacketing 17, consisting of plastic, up to the level of the insertion opening 14, which jacketing has oblique support edges 18. As FIG. 2 shows particularly clearly, the insertion opening 14 formed by an opening flange 19, which is formed, on the one hand, by flange edges 20 of the shell part 13*a*, inclined diagonal, by 45°, for example, in relation to the insertion direction a; that is, of a springy shell addition 13*b*, on the one hand, and also at the two narrow sides, and on the other hand, by the rounded lower limit 10*a* of the pressure key 10. With the locking of the insertion tongue 3, the support edges 18 of the jacketing 17 of the insertion tongue 3 is resiliently clamped wit the limit 10*a* of the pressure key and with the flange edge 20 or with the flange edges of the lock shell 13. In FIG. 1, through dot-and-dash circles, the contact points between insertion tongue 3 and belt lock are made clear. By the fact that the insertion tongue 3 comes to lie against diagonal surfaces of the belt lock and by the fact that a part of the opening flange, namely the pressure key 10, is designed as a resilient element, there are given pressure forces and force components at an angle to each other, and at least one pressure force F1, which acts against the insertion direction a, and at least one other pressure force F2, which acts displaced by 90° from the pressure force F1. These force relations are made clear in FIGS. 3 and 4. In these figures the insertion tongue is shown in section and in top view. We see the T-shaped profile of the insertion tongue 3, only half of which is represented in FIG. 4, and which has one opening 21 for the fastening with a flexible belt band and the opening 16 for the formation of the catch edge 15, 22 is the point at which the catch edge 15 of the insertion tongue 3 is in contact with the bar 8. Indicated by curved arrows c and d are the swinging (vibration) directions in which the insertion tongue 3 is excited to vibrations as a result of shaking of the vehicle. We see in FIG. 3 the points 20 and 10*a*, by which the jacketing 17 of the insertion tongue 3 is resiliently clamped, while, as explained, the spring effect is attained through the resilient pressure key 10 and/or through the resilient shell addition 13*b*. In this way, at least two force components, F1 and F2, are given. The pressure force F1, or the corresponding counter-force should be less here than the spring force of the spring 12, which acts on the pressure key 10, so that with shakings (vibrations) of the vehicle, the pressure key 10 will in no case be moved in the insertion direction (arrow e).

In view of the foregoing description, it is apparent that the belt lock or buckle and tongue assembly of FIG. 1 includes a buckle and a tongue 3. The tongue 3 has a metal base with a leading end portion which is insertable into the buckle, as shown in FIG. 1. A jacket 17 of plastic covers a trailing end portion of the tongue (not shown) and at least a portion of an intermediate section of the tongue. The latch bar or member 8 engages the metal base of the tongue (as shown in FIG. 1) to block withdrawal of the tongue from the buckle.

In accordance with a feature of the present invention, rattle or knocking noises are prevented by holding the tongue against sidewise movement, that is, up and down movement as viewed in FIG. 1, relative to the housing. To hold the tongue against sidewise movement relative to the housing, a force is applied against the jacket of the tongue. This force is shown in FIG. 1 as having a horizontal force component extending parallel to the direction of insertion of the tongue into the housing and a vertical component extending perpendicular or transverse to the direction of insertion of the tongue into the housing.

The rattle preventing forces are applied to the jacket 17 of the tongue by both pressure key or actuator member 10 and a resilient flange 13*b* on the housing. The pressure key or actuator member 10 is movable inwardly, that is, in the direction of the arrow b in FIG. 1, against the influence of a biasing spring 12 to move the latch member 8 upwardly to release the tongue for withdrawal out of the buckle. The spring 12 urges the actuator member back to the extended position shown in FIG. 1 to maintain the latch member 8 in a position in which it blocks withdrawal of the tongue from the buckle.

The spring 12 is also effective to press the outer surface area of a portion of the actuator member designated 10*a* in FIG. 2 against the jacket 17 to apply a force against the jacket urging the tongue downwardly and outwardly, that is, with a force having the components designated F1 and F2 in FIG. 1. In addition, the resilient flange 13*b* is effective to apply an upwardly and outwardly directed force against the jacket 17. Thus, the flange 13*b* applies to the jacket 17 a force having a vertically upward component in a direction opposite to the force F2 of FIG. 1 and an outward component in a direction parallel to the force F1 in FIG. 1. The forces applied against the jacket 17 on the tongue are effective to hold the tongue against sidewise movement and objectionable rattle during use of the buckle and tongue assembly.

I claim:

1. A safety belt lock having a lock housing forming an insertion path for a cooperating insertion tongue movable along said insertion path in opposite insertion and withdrawal directions, and a locking bar movable into said insertion path for engaging said insertion tongue, said lock housing being surrounded by a shell and having an insertion opening aligned with said insertion path, said insertion opening being at least partially defined by a flange which partially extends into said insertion path when said insertion tongue is not inserted, and which resiliently bears on said insertion tongue when said insertion tongue is inserted into said insertion opening, and said flange when resiliently bearing on said insertion tongue applying to said insertion tongue a clamping force component in said withdrawal direction and a clamping force component perpendicular to said insertion direction.

2. The safety belt lock of claim 1, wherein said locking bar is actuatable by a manually operated pressure key and said flange comprises an integral part of said pressure key.

3. The safety belt lock of claim 1, wherein said flange inclined includes a portion at about 45° to said insertion direction.

4. The safety belt lock of claim 2, wherein said pressure key is spring biased in said withdrawal direction by spring means generating a biasing force exceeding said clamping force component in to said withdrawal direction.

5. The safety belt buckle of claim 1, wherein said flange comprises first and second cooperating flange portions, said first flange portion forming an integral part of a manually actuatable pressure key for disengaging said locking bar from said insertion tongue, and said second flange portion forming an integral part of said shell.

6. The safety belt lock of claim 1, wherein said insertion tongue is provided with a jacketing of plastic material, said jacketing having surface portions whereupon said flange bears when said insertion tongue is inserted into said insertion path.

7. A buckle and tongue assembly for use with a safety belt, said buckle and tongue assembly comprising a buckle, a tongue having a leading end portion which is insertable into said buckle and a trailing end portion which is spaced from said buckle when said tongue is inserted into said buckle, said buckle including latch means for engaging the leading end portion of said tongue when said tongue is inserted into said buckle to block withdrawal of said tongue from said buckle, and rattle preventing means for holding said tongue against sidewise movement relative to said buckle when said tongue is inserted into said buckle, said rattle preventing means including means for applying force to said tongue in a direction transverse to the direction of insertion of said tongue into said buckle at a location between the location where said latch means engages said tongue and the trailing end portion of said tongue.

8. A buckle and tongue assembly as set forth in claim 7 wherein said buckle includes an actuator member which is movable relative to said housing from an extended position to a retracted position to operate said latch means from an engaged condition in which said latch means blocks withdrawal of said tongue from said housing to a disengaged condition in which said latch means is ineffective to block withdrawal of said tongue from said housing and spring means for urging said actuator member toward the extended position, said rattle preventing means including a surface area on said actuator member, said spring means being effective to press said surface area on said actuator member against said tongue when said tongue is inserted into said buckle to apply the force to said tongue in a direction transverse to the direction of insertion of said tongue into said buckle.

9. A buckle and tongue assembly as set forth in claim 7 wherein said buckle includes a housing, said rattle preventing means includes a resiliently deflectable portion of said housing, said tongue including surface means disposed between the location where said latch means engages said tongue and the trailing end portion of said tongue for deflecting said resiliently deflectable portion of said housing upon insertion of said tongue into said housing.

10. A buckle and tongue assembly as set forth in claim 7 wherein said tongue includes a base and a plastic jacket disposed over said base, said plastic jacket having an end surface disposed at a location between the location where said latch means engages said tongue and the trailing end portion of said tongue, said rattle preventing means including surface means for applying force against the end surface of said jacket.

11. A buckle and tongue assembly for use with a safety belt, said buckle and tongue assembly comprising a buckle, a tongue insertable into said buckle, said tongue including a base and a jacket which at least partially covers said base, said buckle including latch means for engaging said base of said tongue to block withdrawal of said tongue from said buckle, and rattle preventing means for holding said tongue against sidewise movement relative to said buckle, said rattle preventing means including means for applying against said jacket a force having a first component extending generally parallel to the direction of insertion of said tongue into said buckle and a second force component extending transversely to the direction of insertion of said tongue into said buckle.

12. A buckle and tongue assembly as set forth in claim 11 wherein said buckle includes an actuator member which is movable relative to said housing from an extended position to a retracted position to operate said latch means from an engaged condition in which said latch means blocks withdrawal of said tongue from said housing to a disengaged condition in which said latch means is ineffective to block withdrawl of said tongue from said housing and spring means for urging said actuator member toward the extended position, said rattle preventing means including a surface area on said actuator member, said spring means being effective to press said surface area on said actuator member against said jacket when said tongue is inserted into said buckle to apply the force to said jacket.

13. A buckle and tongue assembly as set forth in claim 11 wherein said buckle includes a housing, said rattle preventing means includes a resiliently deflectable portion of said housing, said jacket including surface means for deflecting said resiliently deflectable portion of said housing upon insertion of said tongue into said housing.

14. A buckle and tongue assembly as set forth in claim 11 wherein said jacket has an end surface disposed in a central portion of said tongue, said rattle preventing means including means for applying said first and second force components against said end surface of said jacket.

* * * * *